United States Patent [19]

Ramaiah

[11] Patent Number: 4,992,703

[45] Date of Patent: Feb. 12, 1991

[54] METAL HALIDE LAMP WITH DUAL STARTING ELECTRODES AND IMPROVED MAINTENANCE

[75] Inventor: Raghu Ramaiah, Painted Post, N.Y.

[73] Assignee: North American Philips Corp., New York, N.Y.

[21] Appl. No.: 469,817

[22] Filed: Jan. 23, 1990

Related U.S. Application Data

[63] Continuation of Ser. No. 851,616, Apr. 14, 1986, abandoned.

[51] Int. Cl.[5] ..... H01J 29/00

[52] U.S. Cl. ..... 315/261; 315/60; 315/74; 315/124

[58] Field of Search ..... 315/60, 261, 74, 124

[56] References Cited

U.S. PATENT DOCUMENTS

| | | | |
|---|---|---|---|
| 2,517,126 | 8/1950 | Macksoud | 315/73 |
| 3,275,397 | 9/1966 | Cushing . | |
| 3,714,494 | 1/1973 | Nakamura | 315/60 X |
| 4,097,777 | 6/1978 | Bacharowski | 315/60 |
| 4,156,830 | 5/1979 | Strauss et al. | 315/73 |
| 4,258,289 | 3/1981 | Michsal | 315/60 |
| 4,529,914 | 7/1985 | Kaneda | 315/335 |

FOREIGN PATENT DOCUMENTS

| | | |
|---|---|---|
| 242239 | 8/1965 | Austria . |
| 481550 | 12/1969 | Switzerland . |

OTHER PUBLICATIONS

High Pressure Mercury Vapour Lamps and Their Applications, Ed. by W. Elenbaas (1965), pp. 114–115.

*Primary Examiner*—James J. Groody
*Assistant Examiner*—Mark R. Powell
*Attorney, Agent, or Firm*—Emmanuel J. Lobato

[57] ABSTRACT

A metal halide high intensity discharge lamp having an arc tube assembly including a pair of discharge electrodes and a pair of starting electrodes. Each starting electrode is adjacent a respective discharge electrode. During starting, the lamp makes the glow discharge to arc discharge transition in a substantially shorter time than a lamp with a single starting electrode, and exhibits a substantially improved lumen maintenance.

7 Claims, 1 Drawing Sheet

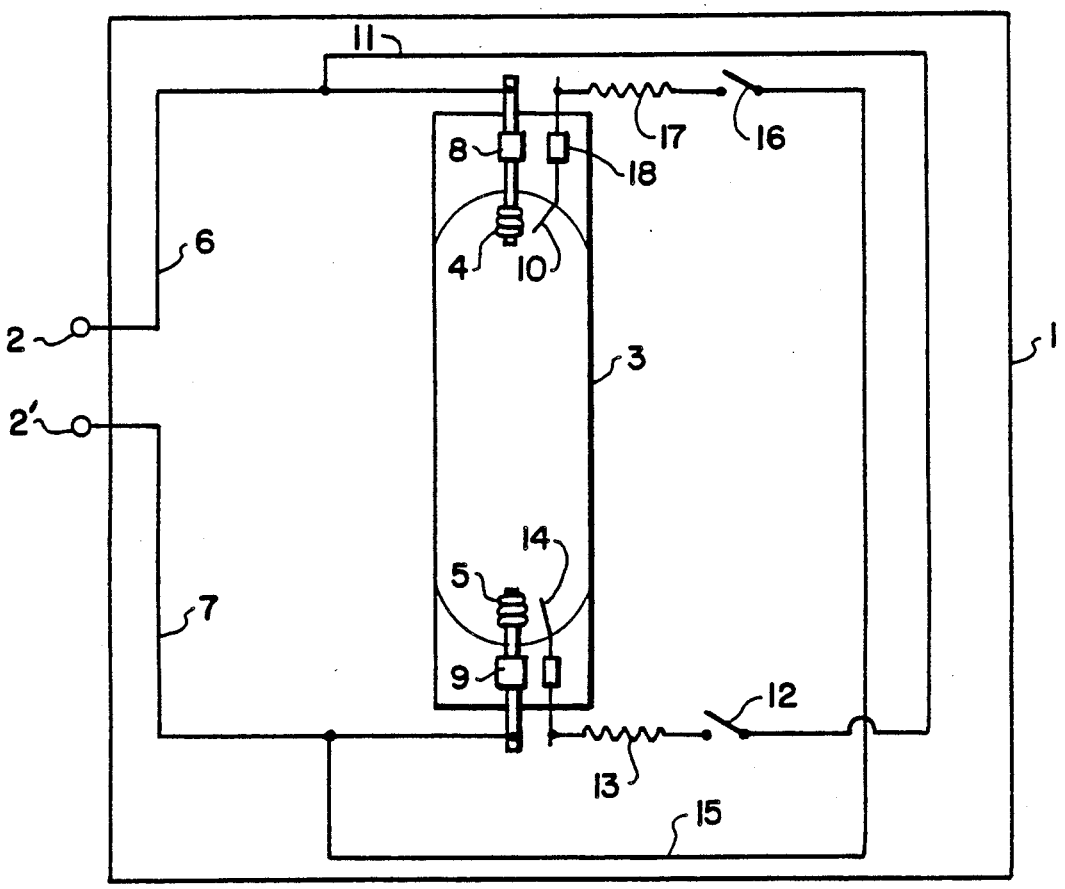
11
17
16
8
18
6
4
10
2
3
1
2'
14
5
7
9
12
13
15

METAL HALIDE LAMP WITH DUAL STARTING ELECTRODES AND IMPROVED MAINTENANCE

This is a continuation of application Ser. No. 851,616, filed Apr. 14, 1986, now abandoned.

BACKGROUND OF THE INVENTION

The present invention relates to a metal halide high intensity electric discharge lamp, and more particularly a metal halide lamp having a starting electrode for each of the lamp discharge electrodes, for improving lamp maintenance.

The use of auxiliary starting electrodes in electric discharge lamps is known. For example, a high pressure mercury vapor discharge lamp having a pair of auxiliary starting electrodes is disclosed in the book High-Pressure Mercury Vapor Lamps and Their Applications, edited by W. Elenbaas, 1965 at page 114. In this lamp the applied voltage is applied not only across the pair of main discharge electrodes, but across each main discharge electrode-auxiliary electrode pair. The applied voltage causes a glow discharge and local ionization in the gap between a main discharge electrode and its adjacent auxiliary electrode, and the electrons thus produced are accelerated between the main discharge electrodes until an arc discharge is fully developed.

Generally, electric discharge lamps use only a single auxiliary electrode. Lamp ballasts have become sufficiently reliable to reliably start discharge lamps, the second auxiliary electrode was dispensed with, and today only a single auxiliary electrode is used. Thus, the standard work on discharge lamp technology, Electric Discharge Lamps by John Waymouth, 1971, teaches the use of a single auxiliary electrode in both high pressure mercury vapor discharge lamps and metal halide discharge lamps.

The use of two starting electrodes in the prior art was solely for the purpose of facilitating starting. Both Austrian Patent No. 242,239 issued Sept. 10, 1965 and Swiss Patent No. 481,550 issued Dec. 31, 1969 disclose discharge lamps having a pair of starting electrodes. In both patents the disclosed improvements relate to lamp starting, and there is no suggestion that the pair of starting electrodes had any other purpose or effect than to improve starting. Moreover, neither of these patents teach the use of two starting electrodes in a metal halide lamp.

U.S. Pat. No. 3,275,397 issued Sept. 27, 1966 discloses a method for processing discharge lamp arc tube assemblies. An arc tube assembly comprises a discharge tube having a pair of discharge electrodes and a pair of auxiliary electrodes. The discharge tube is filled with an inert starting gas, mercury and a metal halide additive. According to the disclosed method an electrical discharge is first developed between the discharge electrodes for driving off occluded gases. Next, an electric discharge is developed between the refractory metal starting electrodes for gettering gaseous impurities within the discharge tube. Thereafter, the arc tube assembly is installed in a finished lamp. There is no suggestion to install the processed arc tube assembly in a lamp so that both starting electrodes are operative.

The problem of improving the lumen maintenance of metal halide lamps is a continuing one. The highly reactive atmosphere within the discharge tube of a metal halide lamp inevitably leads to the deterioration of the discharge electrodes, and to the deposition of material on the discharge envelope walls which darken it. Additionally, these lamps contain sodium as a principal light emitting material, and sodium loss during lamp operation contributes to deterioration in lumen maintenance.

SUMMARY OF THE INVENTION

It is therefore an object of the invention to improve the lumen maintenance of metal halide high intensity discharge lamps.

According to the invention a metal halide high intensity discharge lamp includes a discharge vessel having a pair of discharge electrodes disposed therein, and spaced apart to define therebetween a discharge gap. The discharge electrode pair is energizable for establishing an electrical discharge across the discharge gap and ionizing fill material within the discharge vessel to emit light. A pair of starting probes is also positioned within the discharge vessel, with each starting probe positioned adjacent a respective one of the discharge electrodes and energizable for establishing ionization between it and its respective adjacent discharge electrode.

The lamp further comprises biasing means receptive of a lamp voltage applied in use to the lamp for biasing the discharge electrodes and the starting probes. The biasing means comprises means for biasing each discharge electrode negative relative to its corresponding starting probe during alternating half cycles of the voltage applied to the lamp.

The biasing means is comprised of means for applying substantially the lamp voltage across a first discharge electrode-starting probe pair for negatively biasing the discharge electrode relative to the starting probe during alternate half-cycles of the lamp voltage, and means for applying substantially the lamp voltage across the second discharge electrode-starting probe pair for negatively biasing the discharge electrode relative to the starting electrode during the alternate half-cycles of the lamp voltage when the discharge electrode of the first discharge electrode-starting probe pair is positively biased. Consequently, lamp starting is carried out for each half-cycle of lamp voltage with the discharge electrode of one of the two discharge electrode-starting probe pairs negatively biased relative to its respective starting probe.

IN THE DRAWING

The single FIGURE of the drawing illustrates a discharge tube assembly, and associated biasing circuitry illustrated schematically, in a lamp according to the invention.

DETAILED DESCRIPTION OF THE INVENTION

The metal halide electric discharge lamp according to the invention is comprised of an outer envelope 1, shown schematically, having a connector, also shown schematically, comprised of terminals 2, 2'. In operation a voltage for operating the lamp is applied to the connector. The connector 2, 2' is typically defined by a threaded screw base and is conventional structure.

A transparent discharge vessel 3 is disposed within the outer envelope 1 and contains ionizable fill material. The discharge vessel fill includes an ionizable inert starting gas, mercury, and one or more metal halides.

In operation, the lamp voltage applied to the connector 2, 2' is applied through conductive paths 6 and 7 and lead-throughs 8 and 9 across the discharge electrode pair 4, 5. The potential difference across the gap between the electrodes 4 and 5 ionizes the inert starting gas which, in turn, vaporizes the other lamp fill material. Finally, the vaporized lamp fill material is sufficiently ionized and an electric discharge occurs between the discharge electrodes 4 and 5. This electric discharge is highly intense and causes the emission of visible light.

To facilitate starting an auxiliary starting electrode 14 is disposed within the discharge envelope 3 adjacent the discharge electrode 5. The discharge electrode-starting electrode pair 5 and 14 define a small gap in which ionization can occur.

The electric potential applied from the terminal 2 to the discharge electrode 4 through the conductive path 6 is also applied through the conductive path 11, normally closed bimetal switch 12 and current limiting resistor 13 to the auxiliary starting electrode 14. Consequently, the potential difference applied across the input terminals 2, 2' is also applied across the discharge electrode-starting electrode pair 5, 14, except for the voltage drop developed across the current limiting resistor 13.

The potential difference between the discharge electrode 5 and starting probe 14 causes ionization in the gap between them, and the ions are accelerated along the potential difference between the pair of discharge electrodes 4, 5 to establish a current flow across the lamp discharge gap until an electric discharge occurs. The bimetal switch 12 is responsive to the discharge envelope temperature and opens when the discharge envelope 3 is sufficiently heated to not require the auxiliary starting probe 14. The opening of the bimetal switch 12 interrupts the application of the potential from the terminal 2 to the starting probe 14.

During alternate half cycles of the voltage applied across the terminal pair 2, 2' the discharge electrode 5 will be biased negative relative to the starting electrode 14 and then positive relative to the starting electrode 14. When the discharge electrode 5 is negative relative to the starting electrode 14 it operates as a cathode and its electron emission is much more efficient than when the starting electrode 14 is negatively biased relative to the discharge electrode 5 and the starting electrode operates as a cathode. Thus, it is only during alternate half cycles of the applied voltage that the starting electrode 14 makes a substantial contribution to lamp starting.

A second auxiliary starting electrode 10 is disposed adjacent the discharge electrode 4. The potential applied to the input terminal 2' is applied through conductive path 15, normally closed bimetal switch 16 and resistor 17 to the second auxiliary starting electrode 10. Thus, the lamp voltage applied across the terminal pair 2, 2' is substantially applied across the discharge electrode-starting electrode pair 4, 10. The potential difference across the electrode pair 4, 10 causes ionization in the manner previously described, and enhances initiation of the discharge between the discharge electrodes 4, 5.

Because the potential applied to terminal 2 is simultaneously applied to the discharge electrode 4 and the starting electrode 14, while the potential applied to terminal 2' is simultaneously applied to the discharge electrode 5 and the starting electrode 10, the two discharge electrode-starting electrode pairs always have opposite polarity. That is, when one of the discharge electrodes is biased relative to its starting electrode to operate as a cathode, the discharge electrode of the other electrode pair is biased positive relative to its starting electrode. Thus, at least one of the discharge electrodes is always biased as a cathode during each half cycle of lamp voltage. This maximizes the enhancement of discharge initiation by use of auxiliary starting electrodes.

Lamps were made in order to study the operation of metal halide discharge lamps having two auxiliary electrodes connected as starting electrodes. The mounting structure for the discharge vessel was the double frame type, like that disclosed in U.S. Pat. No. 4,245,175 which is incorporated herein by reference. The addition of the second bimetal switch 16 and second current limiting resistor 17 are straightforward additions to the structure shown in the patent.

The two starting electrodes 10 and 14 in a metal halide discharge lamp according to the invention result in an unexpected substantial improvement in lamp maintenance, and an appreciable improvement in lamp efficacy. This is surprising because the lamps included sodium iodide, and a substantial part of the decrease in lamp output was believed to be attributable to the loss of sodium over the life of the lamp. The provision of a second starting electrode should not have influenced the rate of sodium loss and thus not substantially improved light output or maintenance.

Five lamps according to the invention were made and tested. These lamps were 400 watt metal halide lamps having a fill consisting of 51.5 milligrams of mercury, 46.0 milligrams of sodium iodide and 3.7 milligrams of scandium iodide together. Argon at a pressure of 35 Torr was provided as a starting gas. The molar ratio of sodium iodide to scandium iodide was 35 to 1. The electrodes were standard thoriated tungsten electrodes consisting of a straight core and a wire coil wrapped around the core, generally as shown in the drawing. The auxiliary starting electrodes were straight starting electrodes of pure tungsten.

As controls, two identical lamps were made, except that the control lamps had only a single auxiliary starting electrode.

The efficacy of the lamp according to the invention and the control lamps over the first 10,000 hours of lamp operation is summarized in Table I. During lamp tests, at some time between 1000 and 5000 hours, the control lamps were inadvertently disconnected for an unascertained period of time. Thus, the efficacy values of the control lamps for 5000 hours and 10,000 hours are probably lower than the indicated values, and the actual percentage increase in efficacy is probably higher.

TABLE I

| LAMP OPERATING TIME (HR) | LAMP EFFICACY (INVENTION) (LUMENS/WATT) | LAMP EFFICACY (CONTROL) (LUMENS/WATT) | PERCENT INCREASE IN EFFICACY |
|---|---|---|---|
| 100 | 88.7 | 82.5 | 7.5 |
| 1000 | 84.0 | 78.6 | 6.9 |
| 5000 | 74.0 | 66.1* | 12.0** |

TABLE I-continued

| LAMP OPERATING TIME (HR) | LAMP EFFICACY (INVENTION) (LUMENS/WATT) | LAMP EFFICACY (CONTROL) (LUMENS/WATT) | PERCENT INCREASE IN EFFICACY |
|---|---|---|---|
| 10000 | 54.4 | 49.5* | 9.9** |

*(probably lower, see above)
**(probably higher, see above)

The improvement in lamp efficacy and maintenance is the result of just the additional starting probe. There was no difference between the lamp according to the invention and the control lamp, in terms of lamp fill quantity or composition, or any other composition differences in lamp materials. The lamps were the same size, geometry and design. There was no reason to expect that the second starting probe would result in the degree of indicated improvements.

The lamp operating voltage, and change in lamp voltage over the first 10,000 hours of lamp life was also measured. This data is summarized in Table II.

TABLE II

| LAMP OPERATING TIME (HR) | LAMP VOLTAGE (V) (INVENTION) | VOLTAGE RISE (V) | LAMP VOLTAGE (CONTROL) | VOLTAGE RISE (V) |
|---|---|---|---|---|
| 100 | 130.8 | — | 134.5 | — |
| 1000 | 130.6 | −0.2 | 134.0 | −0.5 |
| 5000 | 132.3 | 1.5 | 138.0* | 3.5* |
| 10000 | 135.3 | 4.5 | 143.0* | 8.5* |

*(probably higher, see below)

The initial operating voltage of the lamps having two starting probes is lower than the control lamps with one starting probe. Additionally, the increase in lamp operating voltage over lamp life is substantially less for the present invention. This is an indication that there may be less electrode deterioration because of the two starting probes of the present invention so that lamp voltage does not rise appreciably until well into lamp life when sodium loss inevitably causes some increase in lamp voltage. As discussed above, the data for the control lamps for 5,000 hours and 10,000 hours is probably too low.

Another measure of the improvement of the lamp according to the invention over the prior art is shown by a comparison of the lamp ignition times and glow-to-discharge transition times. To determine these parameters the lamp voltage was measured on an oscilloscope (Nicolet 4094) triggered by the lamp open circuit voltage applied by the lamp ballast. The ignition time $T_I$ is the time from the initial application of the ballast open circuit voltage to the time a sharp voltage drop was observed on the oscilloscope, which marks the onset of the glow discharge. The time for transition from glow to arc discharge, $T_{GA}$, was the time measured for the lamp voltage after ignition to drop to approximately 30 volts.

TABLE III

| LAMP | HOURS OF OPERATION | $T_I$(ms) | $T_{GA}$(ms) |
|---|---|---|---|
| Control No. 1 | 100 | 1500 | 1630 |
| Control No. 2 | 12000* | 5970 | 2790 |
| Invention No. 1 | 12000 | 1430 | 500 |
| Invention No. 2 | 12000 | approx. 0 | 730 |

*(probably shorter, see below)

Control lamp no. 1, which was not one of the lamps contributing to the data of Tables I and II, exhibited a glow to arc transition time of about 1.6 seconds. Control lamp no. 2, selected at random from the lamps tested in connection with Tables I and II, required about 2.8 seconds to make the transition from glow to arc discharge. Although Table III shows 12000 hours of operation for control lamp no. 2, the actual number of hours is less as discussed above.

Lamps nos. 1 and 2 according to the invention were also selected at random and exhibited a glow to arc transition time of about 0.5 to 0.73 seconds. In the case of lamp no. 2, the short ignition time was difficult to measure and the entire time to arc onset was attributed to the glow to arc transition. Almost certainly, the ignition time was non-zero and the glow to arc transition was less than 0.73 seconds.

The glow-to-arc transition time is a very significant parameter. During glow discharge the negatively biased discharge electrode is immersed in a plasma sheath and bombarded by heavy argon ions. The collision process causes sputtering of tungsten atoms from the discharge electrode which results in electrode deterioration and blackening of the discharge vessel. The short glow to arc transition times which characterize the present invention appear to indicate that less electrode deterioration occurs in the present than in conventional single starting probe lamps and is consistent with the data of Tables I and II.

A measure of the effectiveness of the invention can be determined by visual inspection of the lamps. After 10,000 hours of operation the discharge vessel of the lamp according to the invention remained sufficiently clear to look into the discharge vessel, with the lamp inoperative, and see the electrodes. The discharge vessels of the control lamps, on the other hand, were completely opaque, from the deposition of dark material on the inside surface of the discharge vessel. This dark material is believed to be a tungsten or a tungsten compound formed from tungsten sputtered from the electrodes.

The experimental data can be summarized. A lamp according to the invention having two starting probes will initially exhibit a lower operating voltage, a shorter glow to arc transition time and a higher efficacy than an otherwise identical lamp having only one starting probe. With increasing lamp operating time, the efficacy of a lamp according to the invention will decrease less, its operating voltage will increase less and its glow-to-arc transition time will increase less than an otherwise identical single starting probe lamp.

The metal halide discharge lamp according to the invention is not limited to the particular embodiments disclosed herein. In particular, variations in internal support structure for the arc tube, lamp base design and other mechanical aspects of the lamp not material to the novel aspects of this invention may be changed.

What is claimed is:

1. In a metal halide high intensity discharge lamp of the type having a discharge vessel and an ionizable fill material including a metal halide ionizable for emitting highly intense visible light, the improvement comprising:

a pair of discharge electrodes disposed within said discharge vessel and spaced apart to define therebetween a discharge gap, each of said discharge electrodes consisting essentially of a straight tungsten core and a tungsten wire coil wrapped around said core, and said pair of discharge electrodes energizable for establishing an electrical discharge across the discharge gap therebetween and ionizing said fill material to emit light;

a pair of straight starting probes, each disposed within said discharge vessel adjacent a respective one of said discharge electrodes and energizable for establishing ionization between it and its respective discharge electrode adjacent thereto;

biasing means receptive of a lamp voltage applied in use to the lamp for biasing said discharge electrodes and said starting probes, said biasing means comprising means for alternately biasing each discharge electrode negative relative to its respective starting probe during alternate half cycles of the voltage applied to the lamp; and the combination of said starting probes and said biasing means being effective for shortening the glow to arc transition time of the lamp to less than one second.

2. In a metal halide discharge lamp according to claim 1, wherein said biasing means is comprised of means for applying substantially the lamp voltage across a first discharge electrode-starting probe pair for negatively biasing the discharge electrode relative to the starting probe during alternate half-cycles of the lamp voltage, and means for applying substantially the lamp voltage across the second discharge electrode-starting probe pair for negatively biasing the discharge electrode relative to the starting probe during the alternate half-cycles of the lamp voltage when the discharge electrode of said first discharge electrode-starting probe pair is positively biased, whereby lamp starting is carried out for each half-cycle of lamp voltage with the discharge electrode of one of the two discharge electrode-starting probe pairs negatively biased relative to its respective starting probe.

3. In a metal halide discharge lamp according to claim 2, wherein each of said means for applying substantially the lamp voltage across a discharge electrode-starting probe pair includes means responsive to temperature for interrupting the lamp voltage applied to said starting probe when the discharge vessel temperature exceeds a certain value.

4. In a metal halide discharge lamp according to claim 3, wherein said means for interrupting are each comprised of a normally closed bimetal switch connected in series with a respective starting probe and responsive to the discharge vessel temperature for opening and interrupting the application of the bias voltage to said respective starting probe with said respective starting probe unconnected to a discharge electrode when said normally closed bimetal switches open in response to the discharge vessel temperature exceeding a certain value.

5. In a metal halide discharge lamp according to claim 2, wherein each of said means for applying substantially the lamp voltage across a discharge electrode-starting probe pair includes means for limiting the flow of current through said starting probe.

6. In a metal halide discharge lamp according to claim 5, wherein said means for limiting the flow of current is comprised of a resistor in series with the starting probe.

7. In a metal halide discharge lamp according to claim 6, further comprising a pair of bimetal switches each connected in series with a respective starting probe and responsive to the discharge vessel temperature for opening and interrupting the application of the bias voltage to said respective starting probe with said respective starting probe unconnected to a discharge electrode when said normally closed bimetal switches open in response to the discharge vessel temperature exceeding a certain value.

* * * * *